United States Patent [19]

Wand

[11] 4,269,087

[45] May 26, 1981

[54] TOOL ASSEMBLY FOR MOUNTING A WIRE CLIP TO A GRID MEMBER OF A FALSE CEILING

[76] Inventor: Lawrence J. Wand, 6607 N. Ponchartrain, Chicago, Ill. 60646

[21] Appl. No.: 15,880

[22] Filed: Feb. 27, 1979

[51] Int. Cl.[3] ..... B25B 7/00

[52] U.S. Cl. ..... 81/5.1 R; 81/425 R; 294/111; 294/117

[58] Field of Search ..... 7/125; 29/243.56; 81/5.1 R, 415–417, 427, 9.3, 425 R; 294/99 S, 111, 117, 22

[56] References Cited

U.S. PATENT DOCUMENTS

| | | | |
|---|---|---|---|
| 598,907 | 2/1898 | Church et al. | 29/243.56 |
| 1,891,164 | 12/1932 | Klüglein | 81/5.1 R |
| 2,885,781 | 5/1959 | Bauer | 81/417 X |
| 2,952,175 | 9/1960 | Edlen et al. | 81/425 R X |
| 3,037,767 | 6/1962 | Haynes et al. | 81/5.1 R X |
| 3,161,086 | 12/1964 | Kircher | 81/5.1 R X |
| 3,847,037 | 11/1974 | Fox | 81/425 R X |

FOREIGN PATENT DOCUMENTS

| | | | |
|---|---|---|---|
| 722855 | 3/1932 | France | 81/9.3 |

*Primary Examiner*—James G. Smith

*Attorney, Agent, or Firm*—Thomas R. Vigil

[57] ABSTRACT

The tool assembly includes a pliers comprising two pivotally connected elongate members each having a handle portion and a jaw portion. The jaw portion has an arcuate section with an elongate groove on the inside thereof facing a like groove in the opposing jaw portion whereby the arcuate sections can readily grip a tear drop shaped wire spring clip for mounting the clip to a grid member of a false ceiling. Also the tool assembly includes two L shaped arms which are adapted to be attached to each other by two fasteners and to a pivot fastener of the pliers. The upper end of each arm has a cushion for engaging a false ceiling tile to move the same upwardly to facilitate insertion of the wire clip on a grid member. The tool assembly further includes an adapter connectable between the pliers and a pole whereby one can manipulate a sleeve on the pole to operate the pliers. Still further, the assembly includes a clip removing device having upper outer ends facing laterally outwardly of the device with grooves therein for engaging a wire clip adjacent the ends thereof for releasing the wire clip from a grid member and an adapter which is connectable between the clip removing device and the pole.

9 Claims, 8 Drawing Figures

FIG. 1
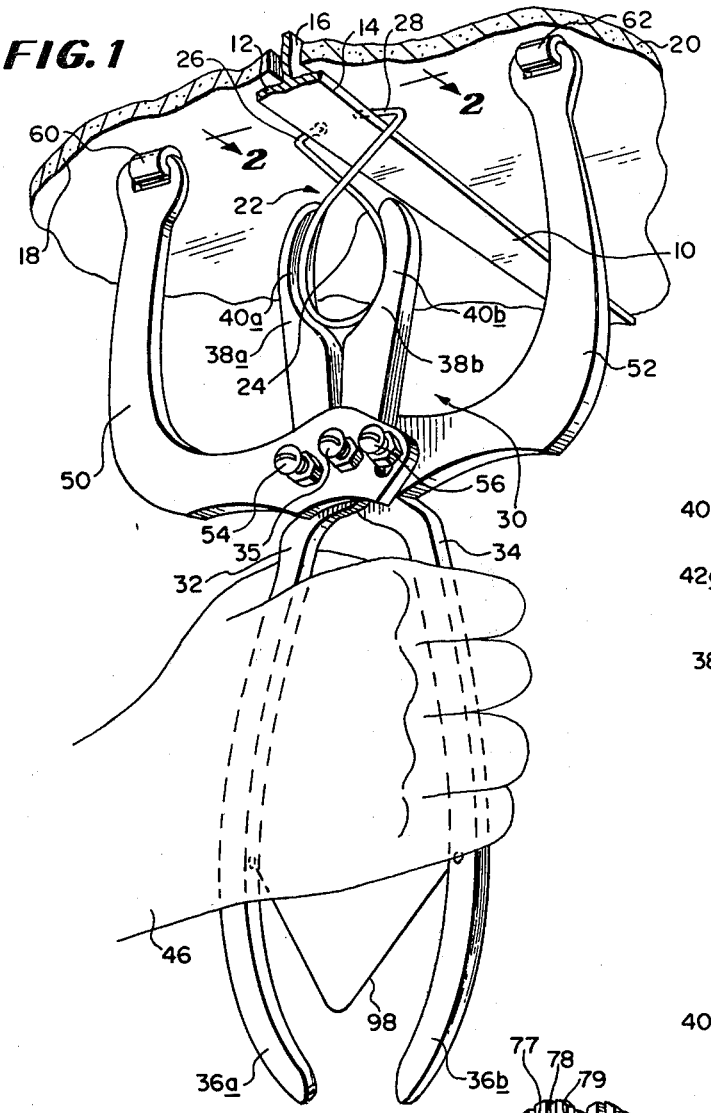
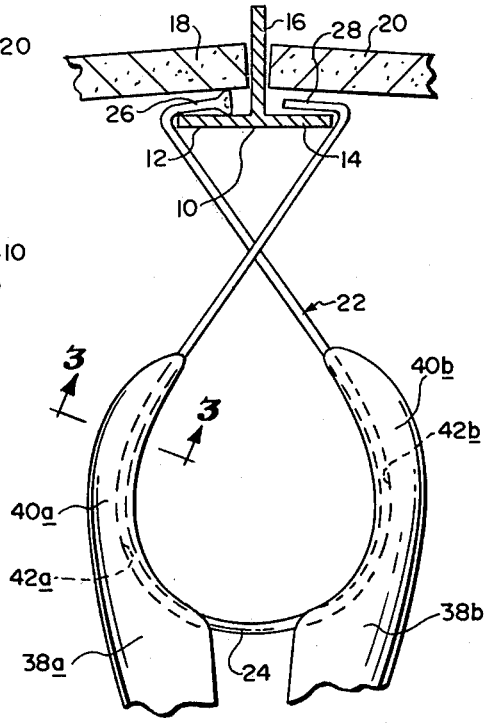
FIG. 2
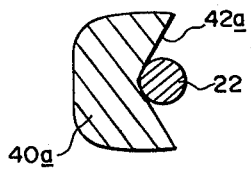
FIG. 3
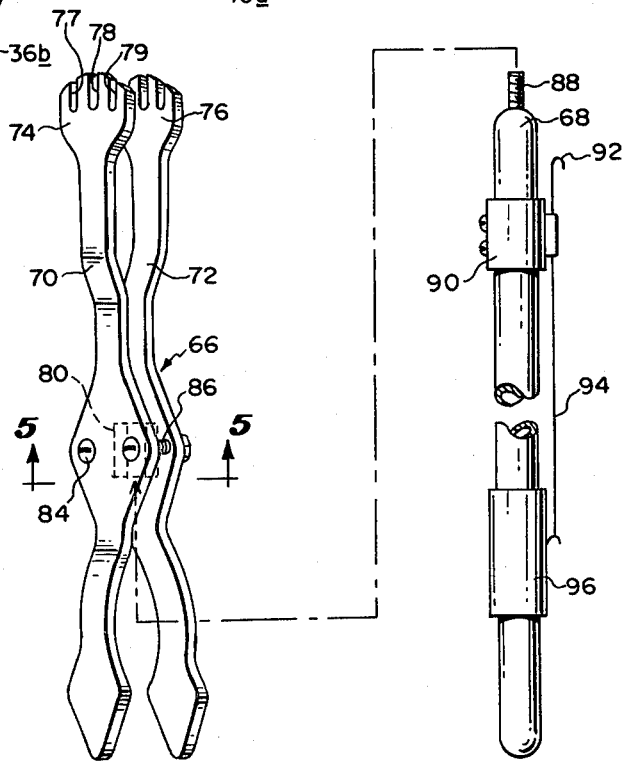
FIG. 4
FIG. 5
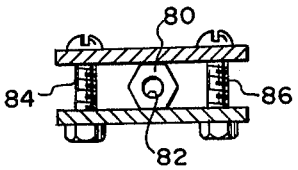

TOOL ASSEMBLY FOR MOUNTING A WIRE CLIP TO A GRID MEMBER OF A FALSE CEILING

BACKGROUND OF THE INVENTION

1. Field of the Invention

The field of the invention is a tool assembly for mounting a tear drop shaped wire spring clip to a grid member of a false ceiling.

2. Description of the Prior Art

Heretofore tear drop shaped wire spring clips having laterally extending end portions at the top thereof have been mounted to a grid member of a false ceiling by squeezing the tear drop portion to move the outer ends outwardly of each other and then placing those outer ends about the lower horizontal section of an inverted T cross section grid member. Then release of the tear drop portion will cause the outer ends of the clip to engage against the side edges of the grid member with the outer ends located above the grid member so that a desired item can be hung from the tear drop portion.

Such wire clips are widely used in stores, i.e., department stores where it is desired to hang signs, articles of wearing apparel, balloons, etc. from the ceiling. At the present time, such wire clips are usually mounted by hand using a step-ladder. Oftentimes it is somewhat awkward to climb up a ladder and squeeze the tear drop portion to hang the clip on, or to remove the clip from, a grid member.

As will be described in greater detail hereinafter, the present invention differs from the previous manual methods for mounting a spring clip by providing a tool assembly comprising a pliers specially configured and designed for mounting a clip to a grid member and a clip removing device specially designed for removing the clip from a grid member. Further, the assembly includes adapters and a pole mountable to each adapter with each adapter being particularly configured and designed for connection to one of the tools, e.g., to the pliers or to the clip removing device whereby one can move a sleeve on the pole while standing on the floor to operate either tool to insert or remove a wire spring clip from a grid member of a false ceiling without the use of a ladder.

SUMMARY OF THE INVENTION

According to the invention there is provided a pliers for mounting a tear drop shaped, wire spring clip with upper opposed laterally extending ends to a grid member of a false ceiling, said pliers comprising two elongate members, each elongate member having a handle portion and a jaw portion and being pivotally connected to the other elongate member at the junction between said handle portion and said jaw portion by a pivot fastener, said jaw portions being opposed to and aligned with each other and each jaw portion having an arcuate end section with a concave curved inner surface and with an elongate groove extending arcuately longitudinally of the end section in the concave inner surface thereof, and said groove facing and being aligned with a like groove in the opposing jaw portion, and the grooves in the arcuate sections of the jaw portion being sized and configured to readily grip the tear drop portion of a tear drop shaped wire spring clip.

Further according to the invention there is provided a clip removing device comprising a pair of elongate arm members, each of said elongate arm members including a V section and a curved section extending from one end of said V section, said arm members being pivotally connected to each other at the vertexes of said V sections with a pivot fastener, a lower leg of each V section being connected to each other by a spring at the junction between said upper legs of the V sections and said curved sections, each curved section having an outer L-shaped end formation facing laterally outwardly of said device and having a groove in one leg of the L for engaging a wire clip adjacent one end thereof for releasing the wire clip from a grid member when the handle members are moved downwardly toward each other.

Still further according to the invention there is provided a tool kit comprising tools for mounting and removing a tear drop shaped, wire spring clip with opposed laterally extending ends to and from a grid member of a false ceiling, said kit including a pliers comprising two elongate members, each elongate member having a handle portion and a jaw portion and being pivotally connected to the other elongate member at the junction between said handle portion and said jaw portion by a pivot fastener, said jaw portions being opposed to and aligned with each other and each jaw portion having an arcuate end section with a concave curved inner surface and with an elongate groove extending arcuately longitudinally of the end section in the concave inner surface thereof, and said groove facing and being aligned with a like groove in the opposing jaw portion, and the grooves in the arcuate sections of the jaw portions being sized and configured to readily grip the tear drop portion of a tear drop shaped wire spring clip, and a clip removing device comprising a pair of elongate arm members, each of said elongate arm members including a V section and curved section extending from one end of said V section, said arm members being pivotally connected to each other at the vertexes of said V sections with a pivot fastener, a lower leg of each V section forming a handle portion and an upper leg of each V section being connected to said curved section, and said arm members being connected to each other by a spring at the junction between said upper legs of the V sections and said curved sections, each curved section having an outer L-shaped end formation facing laterally outwardly of said device and having a groove in one leg of the L for engaging a wire clip adjacent one end thereof for releasing the wire clip from a grid member when the handle members are moved downwardly toward each other.

BRIEF DESCRIPTION OF THE DRAWINGS

FIG. 1 is a perspective elevational view of the pliers of the tool assembly of the present invention as it is being used in mounting a wire spring clip to a grid member of a false ceiling.

FIG. 2 is a fragmentary vertical sectional view taken along line 2—2 of FIG. 1.

FIG. 3 is a sectional view taken along line 3—3 of FIG. 2.

FIG. 4 is a perspective view of an adapter and a pole for use with the pliers shown in FIG. 1.

FIG. 5 is a sectional view taken along line 5—5 of FIG. 4.

DESCRIPTION OF THE PREFERRED EMBODIMENTS

Figure 6:
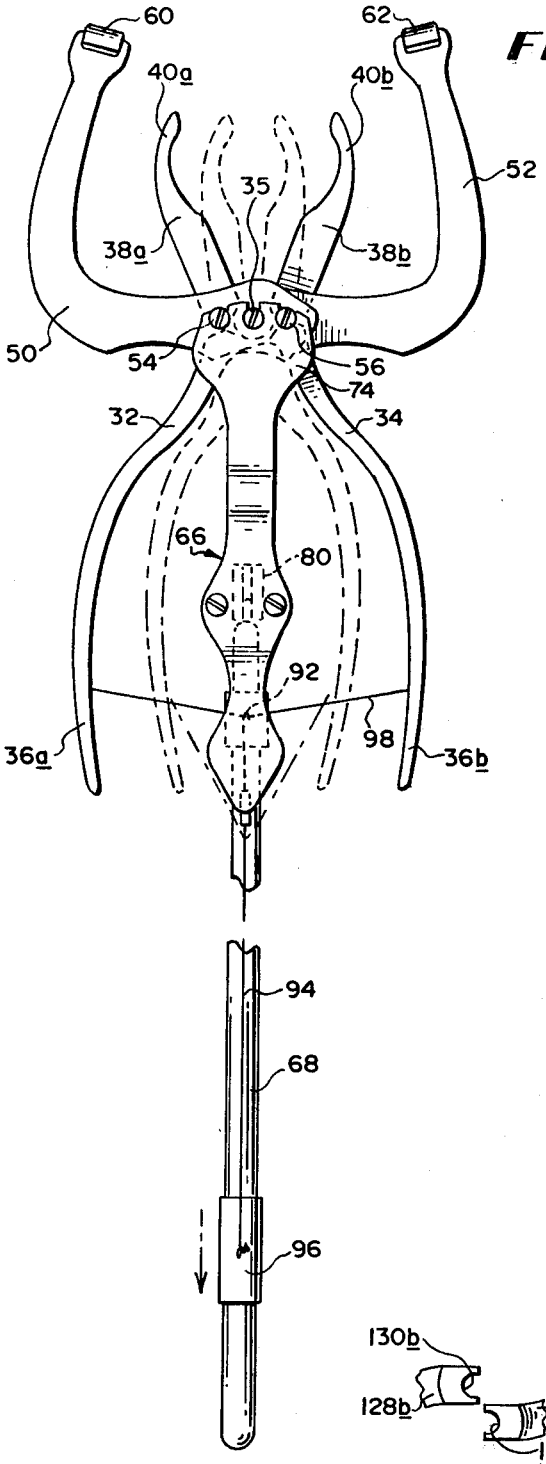
FIG. 6 is an elevational view of the pliers, adapter and pole connected together.

Referring now to FIG. 1 there is illustrated therein a portion of a false ceiling comprising a grid member 10 having an inverted T shaped cross section so as to have horizontally extending flanges 12 and 14 and an upstanding portion 16. Positioned on either side of the upstanding portion 16 and resting on the flanges 12 and 14 are respective ceiling tiles 18 and 20.

In FIG. 1 there is also shown a tear drop shaped wire spring clip 22 being mounted to the grid member 10. The clip 22 has a lower tear drop portion 24 and opposed laterally extending ends 26 and 28 which are adapted to be received over and on the flanges 12 and 14. The tear drop portion 24 serves as an eyelet or hook for hanging an article from the ceiling. In this respect such wire clips 22 are widely used in stores, such as department stores, for hanging articles on sale, sale signs, instructions signs or attractors such as reflective items or balloons.

In the mounting of such wire clips 22, one typically grips the tear drop portion 24 and squeezes it to expand the ends 26 and 28 away from each other so they can be slipped over, around and onto the flanges 12 and 14 of the grid member 10.

In accordance with the teachings of the present invention, a pliers 30 of the tool assembly of the present invention is utilized for mounting the clips 22 to the grid member 10. As shown, the pliers 30 includes two elongate members 32 and 34 which are identical to each other and which are pivotally connected together by a pivot fastener 35 in a suitable manner. Each elongate member 32 and 34 includes a handle portion 36*a*, 36*b* and a jaw portion 38*a*, 38*b*, the pivot connection being at the junction between the handle portion 36*a*, 36*b* and the jaw portion 38*a*, 38*b*. Each jaw portion 38*a* and 38*b* has an arcuate section 40*a*, 40*b*. As best shown in FIGS. 2 and 3, each arcuate section 40*a* and 40*b* has a groove 42*a*, 42*b* therein which can have a U shaped cross section or, as shown in FIG. 3, a V shaped cross section for receiving the tear drop portion 24.

It will be appreciated that one utilizing the pliers 30 will grip the same with a hand 46 and squeeze the handle portions 36*a* and 36*b* to compress the tear drop portion 24 of the spring clip 22 to open the outer ends 26 and 28 thereof. Also with the tear drop portion 24 received in the grooves 42*a* and 42*b*, the clip 22 is held steadily in place with the pliers 30. Then, once the ends 26 and 28 are received over, around and on the flanges 12 and 14, pressure on the handle portions 36*a*, 36*b* is released so that the wire spring clip 22 can snap in place around the grid member 10.

The tool assembly of the present invention further includes two L shaped members 50 and 52 which are mounted to the pivot fastener 35 and to each other by means of two fasteners 54 and 56. These fasteners 54 and 56 are positioned on either side of the pivot connection of the elongate members 32 and 34 so that they do not interfere with manipulation of the pliers 30.

The upper end of each L shaped member 52 and 54 is positioned above the upper end of the pliers 30 and has a cushion 60 and 62 mounted thereon. The cushion members 60 and 62 are positioned to engage ceiling tiles 18 and 20 and move them upwardly to facilitate insertion of the ends 26 and 28 of the spring clip around the flanges 12 and 14 of the grid member 10.

Referring now to FIG. 4, there is illustrated therein an adapter 66 which is adapted to mount the pliers 30 on a pole 68. As shown, the adapter 66 includes two elongate plate members 70 and 72 each of which has a slotted fork shaped upper end 74, 76. Since they are identical, only the end 74 is described herein. As shown, the end 74 has three slots 77, 78 and 79 which, as shown in FIG. 6, receive therein the shafts of the fasteners 54, 35 and 56. Likewise similar slots in the end 76 receive therein the shafts of the fasteners 54, 35 and 56 behind the nuts on the ends of those fasteners.

The adapter 66 also includes an elongate nut 80 which has a threaded bore 82 (FIG. 5) therein and which is situated between the plate members 70 and 72 and secured therebetween by two fasteners 84 and 86. The threaded bore 82 extends parallel to and in the same axial direction as the elongate axes of the plate members 70 and 72.

As best shown in FIG. 4, the pole 68 has a threaded stud 88 at the upper end thereof. The stud 88 is adapted to be threadedly received in the threaded bore 82. Also the pole has a fixed sleeve 90 thereon slidably mounting an elongate hook member 92. The bottom of the hook member 92 is connected to a linkage 94 which extends downwardly to, and is connected to, a slidable sleeve 96 on the pole 68.

As best shown in FIG. 6, the upper slotted ends 74 and 76 of the plate members 70 and 72 (FIG. 4) are fastened to the L shaped members 50 and 52 by the fasteners 54, 35 and 56. A wire 98 extends between the lower ends of the handle portions 36*a* and 36*b* and engages the hook member 92. The pole 68, of course, is fixed to the elongate nut 80 so as to form a rigid structure between the L shaped members 50, 52, the adapter 66 (FIG. 4) and the pole 68.

In operating the assembly just described, an operator standing on the floor of a department store can fix a clip 22 between the arcuate sections 42*a* and 42*b* (FIG. 2) of the pliers 30 and by manipulation of the sleeve 96 can pull the wire 98 downwardly to squeeze the wire spring clip 22 between the jaw portions 40*a* and 40*b* to facilitate insertion of the wire spring clip 22 around the flanges 12 and 14 of the grid member 10. This can all be done while standing on the floor of the department store and without the need of a ladder.

Figure 7:
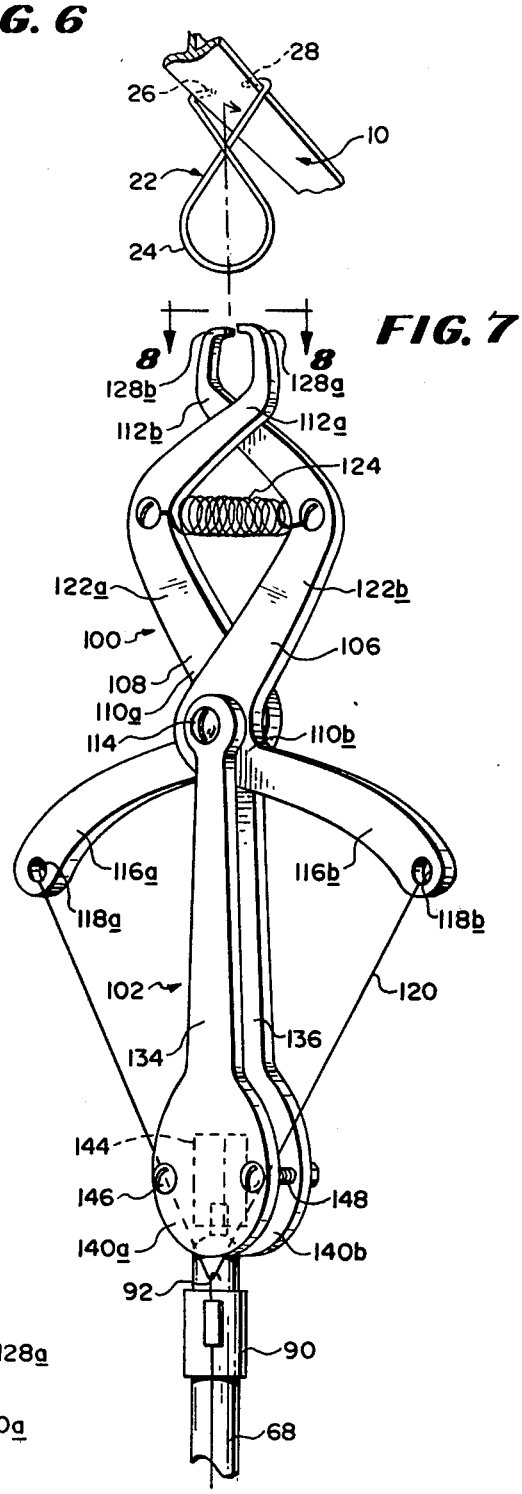
FIG. 7 is a perspective elevational view of a clip removing device of the tool assembly of the present invention mounted to an adapter therefor and the pole.

Referring now to FIG. 7, there is illustrated therein a clip removing device 100 which is mounted by means of an adapter 102 to the pole 68.

The clip removing device 100 includes two specially configured elongate arm members 106 and 108. Each elongate arm member 106 and 108 has a lower V section 110*a*, 110*b* and a curved section 112*a*, 112*b* connected to the upper side of the respective V section 110*a*, 110*b*. The V sections 110*a*, 110*b* are pivotally connected together by a pivot fastener 114 at the vertex of each V.

A lower leg 116*a* 116*b* of each V section 110*a* and 110*b* extends laterally outwardly of the device 100 and forms a lower handle portion for the device 100. The outer end of each handle forming lower leg 116*a*, 116*b* has an aperture 118*a*, 118*b* therein for fixing a wire 120 between the handle portions 116*a*, 116*b* with the wire 120 extending in a V configuration downwardly to the hook member 92 on the pole 68 as shown in FIG. 7.

A spring 124 is connected at the junction between an upper leg 122*a*, 122*b* of each V section 110*a*, 110*b* and the curved section 112*a*, 112*b* integral therewith for biasing the two arm members 106 and 108 toward each other.

Figure 8:
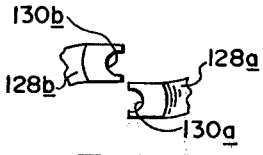
FIG. 8 is a partial end view taken along line 8—8 of FIG. 7.

As shown in FIGS. 7 and 8, at the upper end of each curved section 112*a*, 112*b* is an L shaped end formation 128*a*, 128*b*. Each L shaped end formation 128*a*, 128*b* has a groove 130*a*, 130*b* as shown in FIG. 8. Each of these grooves 130*a*, 130*b* is adapted to engage the wire spring clip 22 just beneath the grid member 10 for moving the ends 26 and 28 of the spring clip away from each other to remove the clip 22 from the grid member 10.

The adapter 102 includes a pair of elongate plates 134 and 136, the upper end of each plate having an opening therethrough to facilitate mounting of the plates 134, 136 to the pivot fastener 114 connecting the arm members 106, 108 at the vertexes of the V sections 110*a*, 110*b*. The lower end of each of the elongate plates 134, 136 has a paddle shaped portion 140*a*, 140*b* with an elongate bolt 144 situated therebetween and held between the plates 134, 136 by two fasteners 146 and 148. A threaded bore (not shown) in the elongate bolt 144 is adapted to be threadingly received on the threaded stud 88 of the pole 68 for fastening the adapter 102 to the pole 68.

In the operation of the clip removing device 100, one will manipulate the sleeve 96 (not shown in FIG. 7) to move the hook member 92 (FIG. 6) downwardly thereby to move the wire 120 and the handle forming lower leg portions 116*a*, 116*b* downwardly and toward each other against the action of the spring 124 to move the L shaped end formations 128*a*, 128*b* against the upper portions of a wire spring clip 22 clipped onto a grid member 10 just below the grid member 10 to spread the upper ends 26 and 28 of the clip 22 apart so that it can be removed from the grid member 10.

From the foregoing description it will be apparent that the tool assembly of the present invention including the pliers 30, the clip removing device 100, the adapter 66, the adapter 102, and the pole 68 provide an assembly which facilitates easy insertion and removal of wire spring clips 22 onto and from grid members 10 of a false ceiling without the need of a ladder.

Also it will be apparent from the foregoing description that obvious modifications can be made to the components of the tool assembly of the present invention without departing from the teachings of the present invention. Accordingly, the scope of the invention is only to be limited as necessitated by the accompanying claims.

I claim:

1. A pliers for mounting a tear drop shaped, wire spring clip with upper opposed laterally extending ends to a grid member of a false ceiling, said pliers comprising two elongate members, each elongate member having a handle portion and a jaw portion and being pivotally connected to the other elongate member at the junction between said handle portion and said jaw portion by a pivot fastener, said jaw portions being opposed to and aligned with each other and each jaw portion having an arcuate end section with a concave curved inner surface and with an elongate groove extending arcuately longitudinally of the end section in the concave inner surface thereof, and said groove facing and being aligned with a like groove in the opposing jaw portion, and the grooves in the arcuate sections of the jaw portions being sized and configured to readily grip the tear drop portion of a tear drop shaped wire spring clip.

2. The tool assembly according to claim 1 including two L-shaped arms adapted to be attached to each other by two fasteners and to said pivot fastener of said pliers, the upper end of each L-shaped arm having means for engaging a false ceiling tile to move same upwardly to facilitate insertion of the upper opposed ends of the clip about a grid member with said pliers.

3. The tool assembly according to claim 2 wherein said engaging means at the upper end of each of said L-shaped arms comprises a cushion means.

4. The tool assembly according to claim 2 including an adapter which comprises two spaced apart, elongate plate members, a threaded member disposed and secured between said plate members with a threaded bore therein extending parallel to the elongate axis of said plate members, the upper end of each plate member having slots for fitting around the ends of said fasteners utilized for fastening said L-shaped members and pliers together, and an elongate pole having a threaded portion at the upper end thereof adapted to be received in said threaded member between the elongate plate members, said pole having a slidably mounted hook member mounted thereon adapted to engage a wire connected between the two handle portions of said pliers, and the lower end of said hook member being connected by an elongate linkage to a slidable hand manipulatable sleeve on said pole.

5. A tool kit comprising tools for mounting and removing a tear drop shaped, wire spring clip with opposed laterally extending ends to and from a grid member of a false ceiling, said kit including a pliers comprising two elongate members, each elongate member having a handle portion and a jaw portion and being pivotally connected to the other elongate member at the junction between said handle portion and said jaw portion by a pivot fastener, said jaw portions being opposed to and aligned with each other and each jaw portion having an arcuate end section with a concave curved inner surface and with an elongate groove extending arcuately longitudinally of the end section in the concave inner surface thereof, and said groove facing and being aligned with a like groove in the opposing jaw portion, and the grooves in the arcuate sections of the jaw portions being sized and configured to readily grip the tear drop portion of a tear drop shaped wire spring clip, and a clip removing device comprising a pair of elongate arm members, each of said elongate arm members including a V section and curved section extending from one end of said V section, said arm members being pivotally connected to each other at the vertexes of said V sections with a pivot fastener, a lower leg of each V section forming a handle portion and an upper leg of each V section being connected to said curved section, and said arm members being connected to each other by a spring at the junction between said upper legs of the V sections and said curved sections, each curved section having an outer L-shaped end formation facing laterally outwardly of said device and having a groove in one leg of the L for engaging a wire clip adjacent one end thereof for releasing the wire clip from a grid member when the handle members are moved downwardly toward each other.

6. The tool assembly according to claim 5 wherein said outer end of each curved section of said clip removing device has an L-shaped end formation with said groove located in one leg of the L.

7. The tool assembly according to claim 5 wherein said clip removing device includes an adapter comprising a pair of elongate plates, the upper end of each plate having an opening therethrough so as to be adapted to be mounted to the pivot fastener connecting said vertexes of said V sections of said arm members of said clip removing device, a threaded member secured between the lower ends of said plates and having a threaded bore extending therein in a direction parallel to the elongate axis of the plates and a pole having a threaded end adapted to be received in said threaded bore of said threaded member, a slidably mounted hook member mounted on said pole and adapted to engage a wire connected between said lower legs and said hook, the lower end of said hook member being connected by an elongate linkage to a slidable hand manipulatable sleeve on said pole, movement of said sleeve downwardly causing said hook to move downwardly to pull said lower legs of said V sections of said arm members downwardly and toward each other so as to move said curved sections outwardly into engagement with a wire clip fastened to a grid member for removing the wire clip from the grid member.

8. A clip removing device comprising a pair of elongate arm members, each of said elongate arm members including a V section and a curved section extending from one end of said V section, said arm members being pivotally connected to each other at the vertexes of said V sections with a pivot fastener, a lower leg of each V section forming a handle portion and an upper leg of each V section being connected to each other by a spring at the junction between said upper legs of the V sections and said curved sections, each curved section having an outer L-shaped end formation facing laterally outwardly of said device and having a groove in one leg of the L for engaging a wire clip adjacent one end thereof for releasing the wire clip from a grid member when the handle members are moved downwardly toward each other.

9. The clip removing device according to claim 8 including an adapter comprising a pair of elongate plates, the upper end of each plate having an opening therethrough so as to be adapted to be mounted to the pivot fastener connecting said vertexes of said V sections of said arm members of said clip removing device, a threaded member secured between the lower ends of said plates and having a threaded bore extending therein in a direction parallel to the elongate axis of the plates and a pole having a threaded end adapted to be received in said threaded bore of said threaded member, a slidably mounted hook member mounted on said pole and adapted to engage a wire connected between said lower legs and said hook, the lower end of said hook member being connected by an elongate linkage to a slidable hand manipulatable sleeve on said pole, movement of said sleeve downwardly causing said hook to move downwardly to pull said lower legs of said V sections of said arm members downwardly and toward each other so as to move said curved sections outwardly into engagement with a wire clip fastened to a grid member for removing the wire clip from the grid.

* * * * *